US009283669B2

(12) United States Patent
Hassler

(10) Patent No.: US 9,283,669 B2
(45) Date of Patent: Mar. 15, 2016

(54) TOOLBAG WITH SELECTIVELY-REMOVABLE TRAY AND CUSHION

(71) Applicant: Mathew Ryan Hassler, San Antonio, TX (US)

(72) Inventor: Mathew Ryan Hassler, San Antonio, TX (US)

(73) Assignee: Rooster Products International, Inc., San Antonio, TX (US)

( * ) Notice: Subject to any disclaimer, the term of this patent is extended or adjusted under 35 U.S.C. 154(b) by 0 days.

(21) Appl. No.: 14/308,637

(22) Filed: Jun. 18, 2014

(65) Prior Publication Data

US 2015/0367504 A1 Dec. 24, 2015

(51) Int. Cl.

| | |
|---|---|
| ***B65D 33/06*** | (2006.01) |
| ***B25H 3/06*** | (2006.01) |
| ***B65D 33/16*** | (2006.01) |

(52) U.S. Cl.

CPC *B25H 3/06* (2013.01); *B65D 33/06* (2013.01); *B65D 33/16* (2013.01)

(58) Field of Classification Search

CPC ..... B65D 33/06; B65D 33/065; B65D 33/10; B65D 33/105; B65D 33/16; B25H 3/00; B25H 3/06

USPC ..... 206/349–379, 521, 523, 557–565

See application file for complete search history.

(56) References Cited

U.S. PATENT DOCUMENTS

| | | | | |
|---|---|---|---|---|
| 3,777,882 | A * | 12/1973 | McIntyre | 206/523 |
| 4,883,179 | A * | 11/1989 | Dionne | 206/523 |
| 6,126,003 | A * | 10/2000 | Brouard | 206/372 |
| 6,478,463 | B2 * | 11/2002 | Snider | 206/373 |
| 6,915,902 | B2 * | 7/2005 | Brouard | 206/373 |
| 7,694,788 | B2 * | 4/2010 | Hann | B25H 3/02 190/1 |
| 2006/0027475 | A1 * | 2/2006 | Gleason et al. | 206/373 |

* cited by examiner

*Primary Examiner* — Bryon Gehman

(74) *Attorney, Agent, or Firm* — John C. Cave; Gunn, Lee & Cave, P.C.

(57) ABSTRACT

A toolbag having a bag enclosure, a selectively-removable tray, and a cushion. The tray is selectively-fastenable to the enclosure for ease of transport. The tray may be unfastened and the cushion removed for use as a kneeling pad at a work site. The tray may then be used to hold small parts and tools.

9 Claims, 3 Drawing Sheets

TOOLBAG WITH SELECTIVELY-REMOVABLE TRAY AND CUSHION

CROSS REFERENCES TO RELATED APPLICATIONS

Not applicable.

FEDERALLY-SPONSORED RESEARCH

Not applicable.

BACKGROUND OF THE INVENTION

1. Field of the Invention

The present invention relates to the field of bags. More specifically, the present invention relates to a multi-function tool bag that is useful for storing tools.

2. Description of the Related Art

Tool carriers are known to be useful for workers needing to carry a group of tools to and from a work site for a specific job. Although tool carriers have historically been made of metal, more recently, fabric covered tool carriers have become popular. Exemplary prior art tool carriers include those disclosed in U.S. Pat. Nos. 6,823,992; 6,991,104; 7,314,133, 7,314,134; and 8651273. While these tool carriers and others of the prior art are useful in some instances, there are still numerous deficiencies and the potential for more useful tool carriers and tool carrier features.

BRIEF SUMMARY OF THE INVENTION

A toolbag having an enclosure, a removable tray, and a cushion. The tray is selectively-fastenable to the enclosure for ease of transport. The tray may be unfastened and the cushion removed for use as a kneeling pad at a work site. The tray may then be used to hold small parts and tools.

DETAILED DESCRIPTION OF CERTAIN EMBODIMENTS

Figure 1:
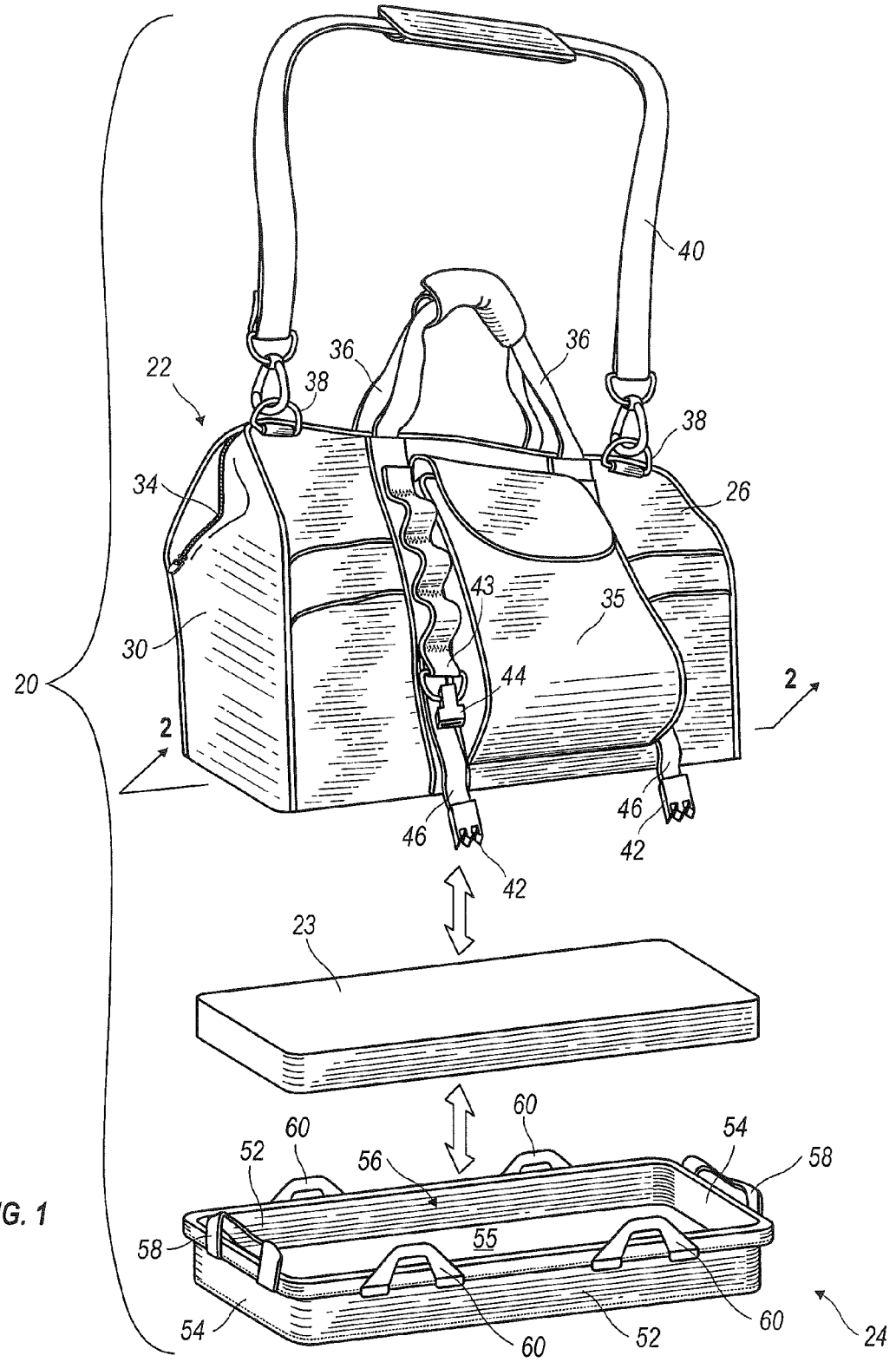
FIG. 1 is a front assembly view of an embodiment of the invention.

FIG. 1 shows an embodiment of a toolbag 20 having the features of the present invention. The toolbag assembly 20 has a bag enclosure 22, a cushion 23, and a tray 24.

Figure 2:
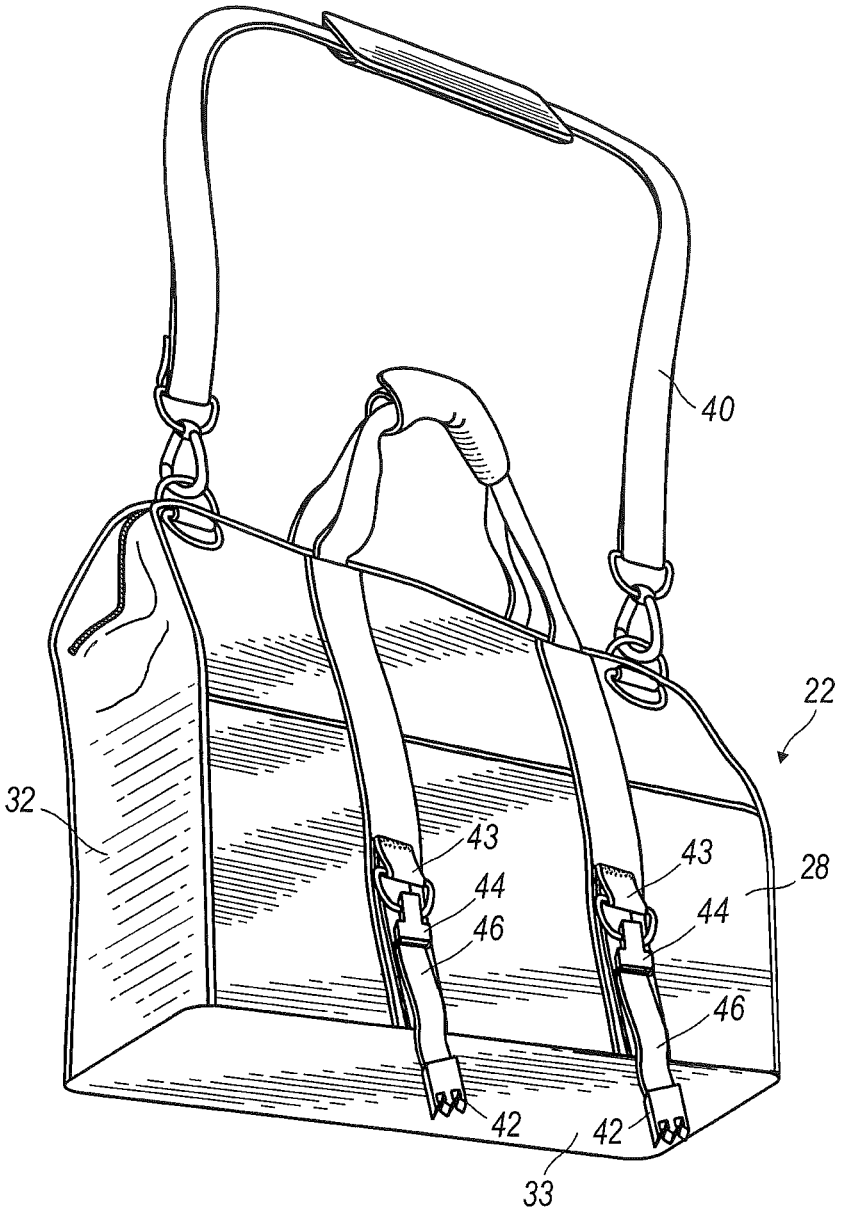
FIG. 2 is a rear isometric view of the enclosure of the embodiment shown in FIG. 1.

Referring jointly to FIGS. 1-2, the bag enclosure 22 has opposing sidewalls 26, 28, opposing endwalls 30, 32, and an adjacent bottom 33. The sidewalls 26, 28 and endwalls 30, 32 taper to a selectively-closeable opening at the top of the bag enclosure 22 that may be closed using a zipper 34 that extends between the endwalls 30, 32. Other methods of closure are also anticipated. Handles 36 are attached to the sidewalls 26, 28. Rings 38 are attached to the first sidewall 26. A shoulder strap 40 is connected to the rings 38. A main exterior pocket 35 is formed adjacent to the first sidewall 26.

Hooks 42 and corresponding catches 44 are attached at to the first sidewall 26 on either side of the main pocket 35 and to the second sidewall 28. Each hook 42 is attached with a strap 46 to the sidewalls 26, 28 near the junction of the sidewalls 26, 28 and the bottom 33. Each corresponding catch 44 is attached to the sidewalls 26, 28 above the associated hook with a loop 43. The hooks 42 and catches 44 may be connected together to form a snap-fit buckle that closes the strap 46 in a small loop near the bottom 33 of bag enclosure 22.

Referring only to FIG. 1, the tray 24 has opposing sidewalls 52 and opposing endwalls 54 connected to a bottom 55. The sidewalls 52 and endwalls 54 define a cuboid tray volume 56 accessible through a generally rectangular opening. Two handles 58 are connected to the endwalls 54. Connection loops 60 with openings therethrough are connected to and extending from the sidewalls 52 near the sidewall edges, with two connection loops 60 attached to each sidewall 52. The tray 24 is made of EVA foam that has a rubber coating.

The cushion 23 is a solid rectangular cuboid and is made of EVA foam. It is sized to frictionally engage the sidewall 52 and endwalls 54 of the tray 24. The height of the cushion 23 is less than the height of the tray 24 that it may be completely positioned within the tray volume 56.

Figure 3:
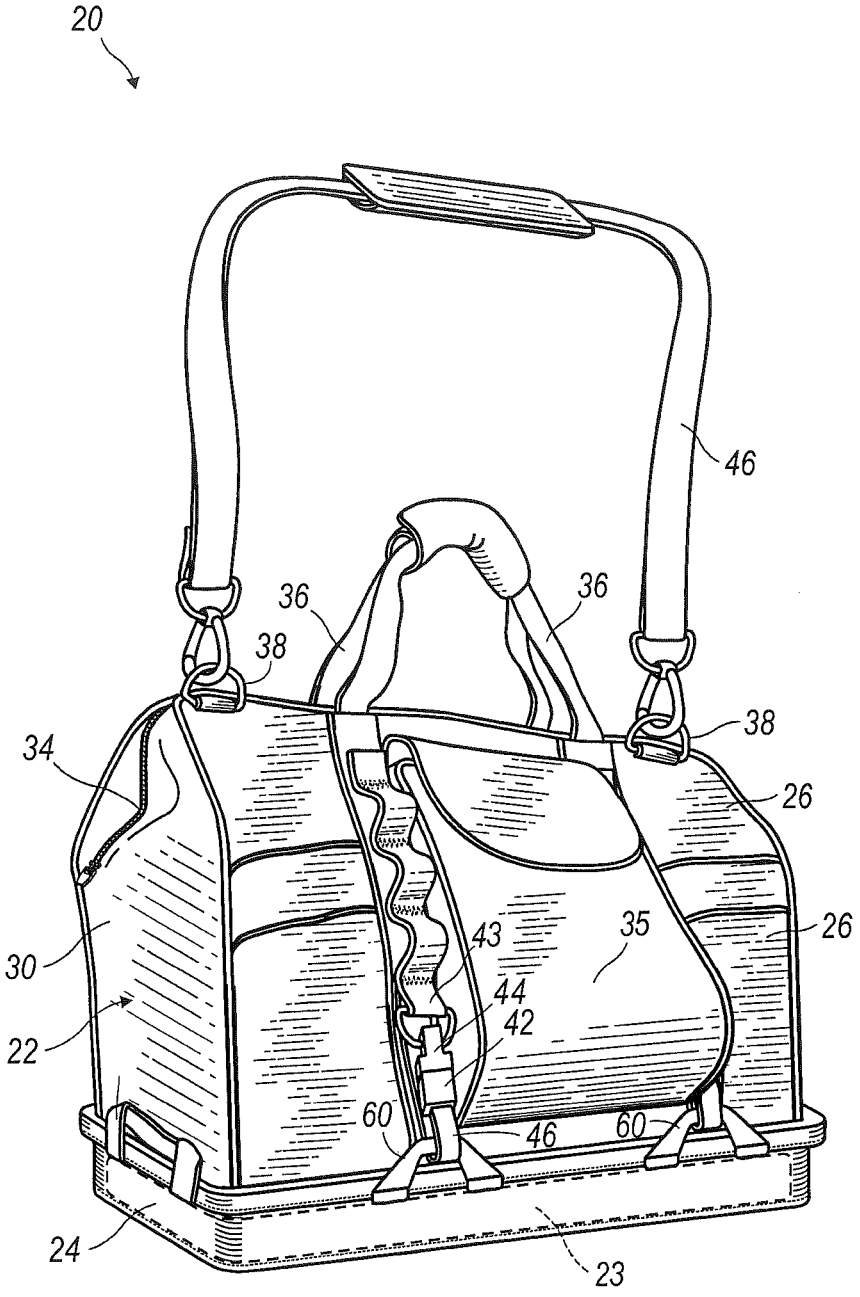
FIG. 3 is a front isometric view of the embodiment.

Referring to FIG. 3, to carry the toolbag 20, the straps 46 are threaded through the connection loops 60, the hooks 42 are then connected to the catches 44. The toolbag 20 may thereafter be lifted and transported with the tray 24. Depending on the length of the straps 46, the tray 24 may be slightly suspended from the bag enclosure 22. The cushion 23 may optionally occupy the tray volume 56. When set down, the bottom 33 of the bag enclosure 22 will rest on the cushion 23 and the bag enclosure 22 will partially occupy the tray volume 56. Preferably, the bottom 33 of the bag enclosure 22 is rectangular and sized to fit within the tray volume 56 with minimum clearance between the bottom 33 of the bag enclosure 22 and the sidewalls 26, 28 and the end walls 30, 32.

Alternatively, the cushion 23 may be removed from the tray volume 56 when the bag enclosure 22 is connected to the tray 24 as described above with regard to FIG. 3. In this alternative, when set down, the bottom 33 of the bag enclosure 22 will rest on the bottom 55 of the tray 24. In this alternative, the bag enclosure 22 will fully occupy the tray volume 56.

The tray 24 may be disconnected from the bag enclosure 22 by unfastening each hook 42 from its corresponding catch 44. Once the tray 24 is disconnected, the cushion 23 may be removed and used as a kneepad, either separately or while still occupying the tray volume 56. If the cushion 23 is used separately from the tray 24 as a kneepad, the tray volume 56 may be used as a small parts container, with the sidewalls 52 and endwalls 54 serving as barriers to prevent movement of parts and tools.

In alternative embodiments, the hooks 42 and catches 44 may form part of the connection loops 60. In still other embodiments, the tray 24 may comprise the hook 42 (or catch 44) portion of a buckle with the corresponding catch 44 (or hook 42) positioned on the enclosure sidewalls 26, 28. And in still other embodiments, the straps 46, hooks 42, catches 44 and connection loops 60 may be positioned at the end walls 30, 32 of the bag enclosure 22 and the end walls 54 of the tray 24 rather than the sidewalls as described with reference to FIGS. 1-3.

The present invention is described in terms of a specifically-described embodiment. Those skilled in the art will recognize that alternative embodiments can be used in carrying out the present invention. Other aspects and advantages of the present invention may be obtained from a study of this disclosure and the drawings, along with the appended claims.

I claim:

1. A toolbag comprising:

a bag enclosure having a bottom surface and at least one enclosure sidewall adjacent to said bottom surface wherein said bottom surface and said at least one enclosure sidewall forms said enclosure;

a plurality of enclosure connection members attached to said at least one enclosure sidewall proximal to a junction of said at least one sidewall with said bottom;

a tray positioned below said bottom surface having a tray bottom and at least one tray sidewall defining a tray volume;

a plurality of tray connection members attached to said at least one tray sidewall for connection with said plurality of enclosure connection members; and an easily removable kneeling cushion at least partially occupying the tray volume.

2. The toolbag of claim 1 wherein at least one enclosure sidewall comprises two enclosure sidewalls and two enclosure end walls, and wherein said at least one tray sidewall comprises two tray sidewalls and two tray end walls.

3. The toolbag of claim 2 wherein at least one of said plurality of enclosure connection members are attached to each of said two sidewalls, and wherein at least one of said plurality of tray connection members is attached to each of said two tray sidewalls.

4. The toolbag of claim 2 wherein at least one of said plurality of the enclosure connection members is attached to each of said two enclosure end walls, and wherein at least one of said plurality of connection members is attached to each of said two tray end walls.

5. The toolbag of claim 1 wherein the at least one enclosure connection member comprises a snap-fit buckle having a hook and a catch and at least one snap.

6. The toolbag of claim 1 wherein each of said plurality of tray connection members is a loop extending from said tray with an opening through said loop.

7. The toolbag of claim 1 wherein each of said plurality of tray connection members are connected to a corresponding enclosure connection member.

8. The toolbag of claim 1 wherein the cushion comprises a foam body.

9. The toolbag of claim 1 wherein the tray comprises a foam body with a rubber coating.

* * * * *